US008162064B1

(12) United States Patent
Penisson

(10) Patent No.: US 8,162,064 B1
(45) Date of Patent: Apr. 24, 2012

(54) AUTONOMOUS JUNK COLLECTING SLEEVE FOR A RISER

(75) Inventor: Dennis J. Penisson, Raceland, LA (US)

(73) Assignee: Wellbore Specialties, LLC, Houma, LA (US)

( * ) Notice: Subject to any disclaimer, the term of this patent is extended or adjusted under 35 U.S.C. 154(b) by 974 days.

(21) Appl. No.: 12/054,362

(22) Filed: Mar. 24, 2008

Related U.S. Application Data

(60) Provisional application No. 60/896,786, filed on Mar. 23, 2007.

(51) Int. Cl.
*E21B 7/12* (2006.01)
*E21B 31/08* (2006.01)

(52) U.S. Cl. ..... 166/368; 166/335; 166/345; 166/99

(58) Field of Classification Search ..... 166/99
See application file for complete search history.

(56) References Cited

U.S. PATENT DOCUMENTS 2,819,038 A 1/1958 Eckel et al.
2,834,300 A 5/1958 Brock et al.
2,894,725 A 7/1959 Baker et al.
3,089,724 A 5/1963 Crooks et al.
3,163,226 A * 12/1964 Lagucki ..... 166/155
3,885,625 A * 5/1975 Ahlstone ..... 166/181
4,059,155 A 11/1977 Greer et al.
4,111,262 A 9/1978 Duncan et al.
6,951,251 B2 10/2005 Penisson et al.
2002/0066578 A1* 6/2002 Broome ..... 166/386

* cited by examiner

*Primary Examiner* — Thomas Beach
*Assistant Examiner* — James Sayre
(74) *Attorney, Agent, or Firm* — Raymond G. Areaux; Ian C. Barras; Carver, Darden, Koretzky, Tessier, Finn, Blossman & Areaux, LLC

(57) ABSTRACT

An autonomous junk collecting sleeve for a riser is provided. The sleeve is constructed and arranged to be independently lowered and seated above a subsea tree section and, subsequently, raised and removed independent of the work string. The autonomous junk collecting sleeve includes a first cylindrical structure, a second cylindrical structure concentric to the first cylindrical structure and which are joined together in spatial relation at a bottom end to form an interior J-channel basket. The J-channel basket is operable to collect debris traveling up through the bottom end and over of the second cylindrical structure for deposit therein.

23 Claims, 4 Drawing Sheets

AUTONOMOUS JUNK COLLECTING SLEEVE FOR A RISER

CROSS-REFERENCE TO RELATED APPLICATIONS

The present application claims priority from U.S. Provisional Application No. 60/896,786, filed Mar. 23, 2007, which is incorporated herein by reference as if set forth in full below.

BACKGROUND OF THE INVENTION

I. Field

The present invention relates to an oilfield tool and more particularly, to an autonomous junk collecting sleeve for a riser which is constructed and arranged to be independently lowered and seated above a subsea tree and, subsequently, raised and removed or cleaned.

II. Background

Various types of junk baskets have been devised for collecting debris from a wellbore during a cleaning operation. The junk basket has a basket dimensioned to collect debris flowing around and external to the basket. The top end of the junk basket is open and relies on free falling debris in the upward-flowing drilling fluid to fall into the opening of the junk basket where it remains until the junk basket is removed. However, the force of the upward-flowing drilling fluid carrying the debris impedes the collection of the debris by the junk basket.

Thus, some junk baskets are not able to collect a substantial portion of the debris in the wellbore, particularly when fluid circulates through the junk basket and upward through an annulus in the well as the basket is retrieved to the surface. Other junk baskets are complicated and are thus relatively expensive.

FIG. 1 illustrates a conventional junk basket 1 having a central mandrel 2 and a basket 4. The annulus between the wellbore 3 and the basket 4 narrows. Thus, the upward-flowing fluid, denoted by ARROW A, has a first speed. The fluid, denoted by ARROW B, has a second speed faster than the first speed as a result of the narrower annulus. The fluid, denoted by ARROW C, continues upward toward the top of the wellbore 3 and is generally slower than the fluid, denoted by ARROW B. However, as the fluid, denoted by ARROW B, passes the upper end of the basket 4, a portion of the fluid automatically travels, in the direction of ARROW E, toward the central mandrel 2 as the annulus is abruptly enlarged. This portion of the fluid flowing in the direction denoted by ARROW E forms small eddy currents created directly over the opening in the basket 4. However, simultaneously, fluid flowing upward, in the direction of ARROW C, recaptures or carries away the debris. Thus, the deposit of debris in the basket 4 is impeded.

Most junk baskets are positioned at various locations in a work string. However, a significant amount of debris is still carried up to the top of the wellbore. The floating debris must be retrieved and removed from the drilling fluid. However, there is not an efficient or quick means of removing the debris near the top of the wellbore.

The slower moving fluid in the riser may not be able to suspend the heavier debris. Thus, the heavier debris floats downward.

Thus, there is a continuing need for an autonomous junk collecting sleeve for use in a riser which is constructed and arranged to be independently lowered and seated above a subsea tree section to collect debris in the riser and, subsequently, raised and removed independent of the work string.

SUMMARY OF THE INVENTION

The present invention contemplates an autonomous junk collecting sleeve for use in a riser comprising: a first outer cylindrical structure, a second inner cylindrical structure concentric to and shorter than the first cylindrical structure and which are joined together in spatial relation at a bottom end to form an interior J-channel basket, the J-channel basket being operable to collect debris traveling up through the bottom end and over the top of the second cylindrical structure for deposit therein.

An object of the present invention is to provide an autonomous junk collecting sleeve with a first cylindrical structure having at a top end, a brim operable to attach a tool thereto to lower and retrieve sleeve.

A further object of the present invention is to provide an autonomous junk collecting sleeve with a first cylindrical structure having a brim which protrudes from the first cylindrical structure toward a longitudinal axis of the first cylindrical structure a distance that approximates the spatial relationship between the first cylindrical structure and the second cylindrical structure.

A still further object of the present invention is to provide an autonomous junk collecting sleeve with a first cylindrical structure that is longer in length than the second cylindrical structure. A hollow interior cavity is formed above a top edge of the second cylindrical structure and below the brim.

A still further object of the present invention is to provide an autonomous junk collecting sleeve with an outer diameter of the first cylindrical structure being slightly smaller than an inner diameter of the riser.

A still further object of the present invention is to provide an autonomous junk collecting sleeve with a second cylindrical structure having an inner diameter which is the same as or larger than the inner diameter of the subsea tree section.

A still further object of the present invention is to provide an autonomous junk collecting sleeve having an inner diameter that allows the sleeve to be seated at a bottom of the riser and supported at a riser seat above a subsea tree section.

A still further object of the present invention is to provide an autonomous junk collecting sleeve with a first cylindrical structure having, at a top end, a brim operable to have attached thereto a fishing tool to autonomously retrieve the sleeve from a bottom of the riser.

The present invention further contemplates an autonomous junk collecting sleeve for a riser and which is independent of a work string. The sleeve comprises a cylindrically-shaped, J-channel basket having a junk collecting space and a hollow throughbore center with access directly into the junk collecting space. The J-channel basket is operable to collect debris traveling up through the bottom end of the hollow throughbore center and over the access for deposit of the debris in the junk collecting space.

The present invention further contemplates a method of cleaning a wellbore. The method comprises: cleaning a riser from an upper surface to a subsea tree section; lowering an autonomous junk collecting sleeve at a seat of the riser; installing a work string through the riser and the autonomous junk collecting sleeve to a depth of the wellbore, the work string being independent of the sleeve; cleaning a wellbore with the work string; and collecting debris from the wellbore in the autonomous junk collecting sleeve, simultaneously with the cleaning of the wellbore.

An advantage of the autonomous junk collecting sleeve is its autonomy from the work string. Thus, the autonomous junk collecting sleeve may be deployed, emptied and re-deployed independent of the work string.

A further advantage of the autonomous junk collecting sleeve is the increased junk collecting space provided in the J-channel basket to collect larger amounts of debris including heavy and larger size debris suspended in the riser.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals.

Figure 1:
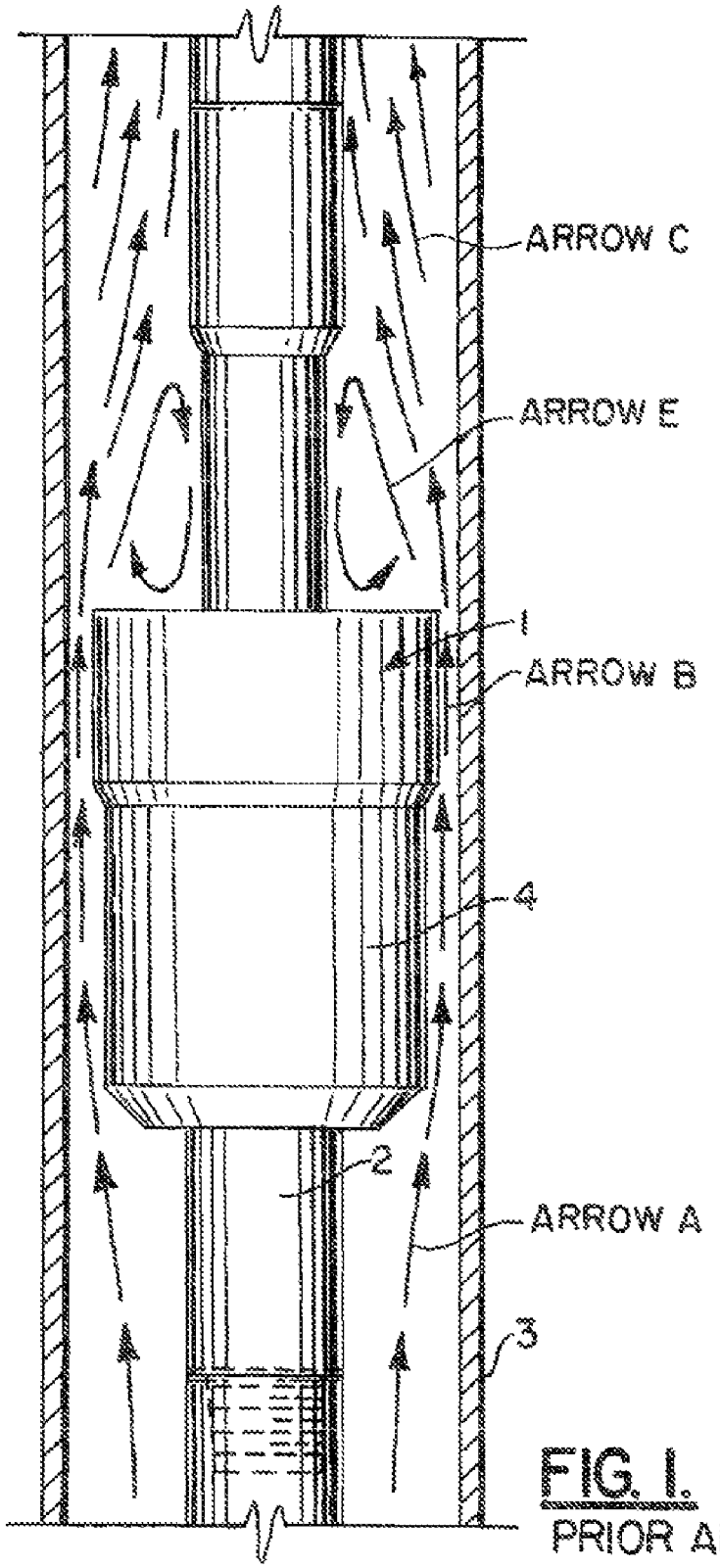
FIG. 1. PRIOR ART
FIG. 1 illustrates a conventional junk basket installed in a wellbore below a riser.

The images in the drawings are simplified for illustrative purposes and are not depicted to scale. To facilitate understanding, identical reference numerals have been used, where possible, to designate identical elements that are common to the Figures, except that suffixes may be added, when appropriate, to differentiate such elements.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

Figure 2:
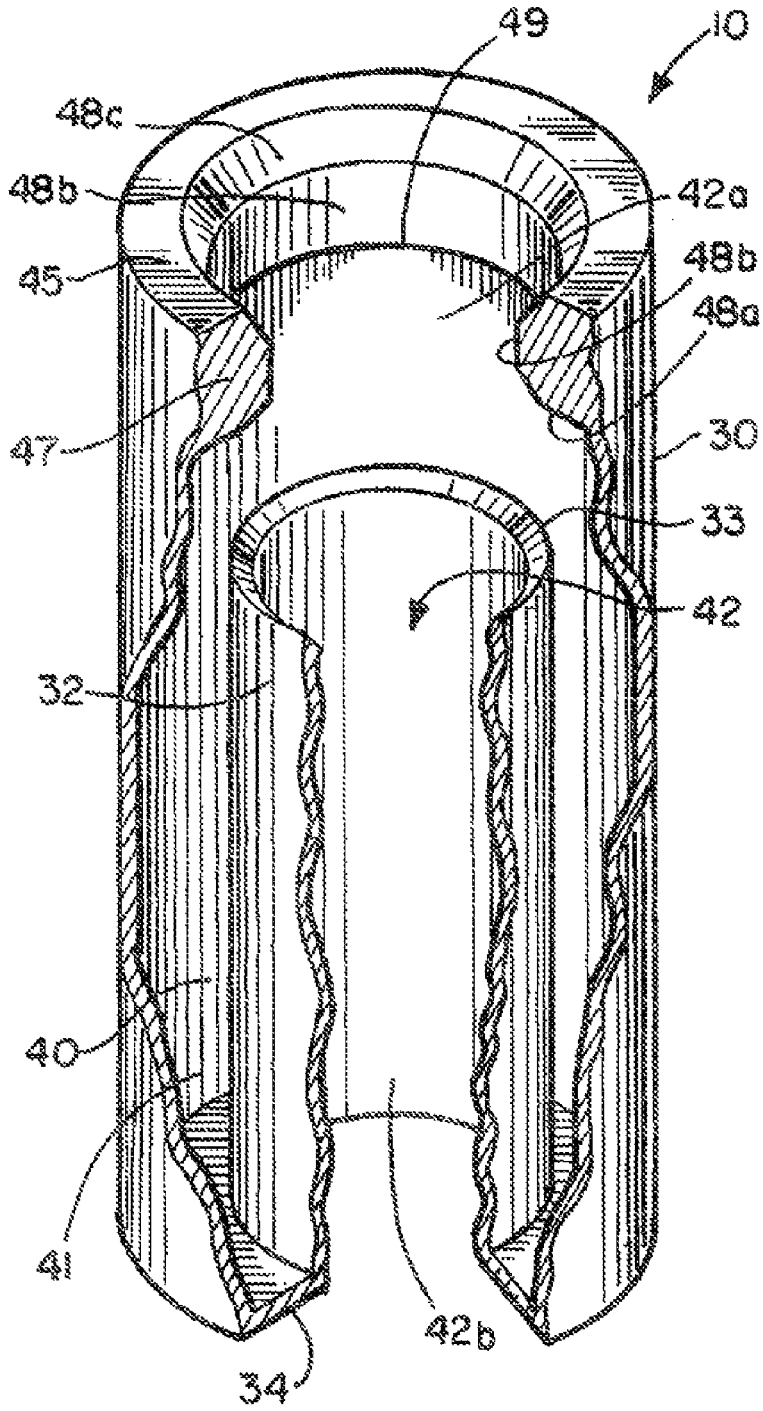
FIG. 2 illustrates a perspective view of an autonomous junk collecting sleeve in accordance with the present invention with a portion removed.
Figure 3:
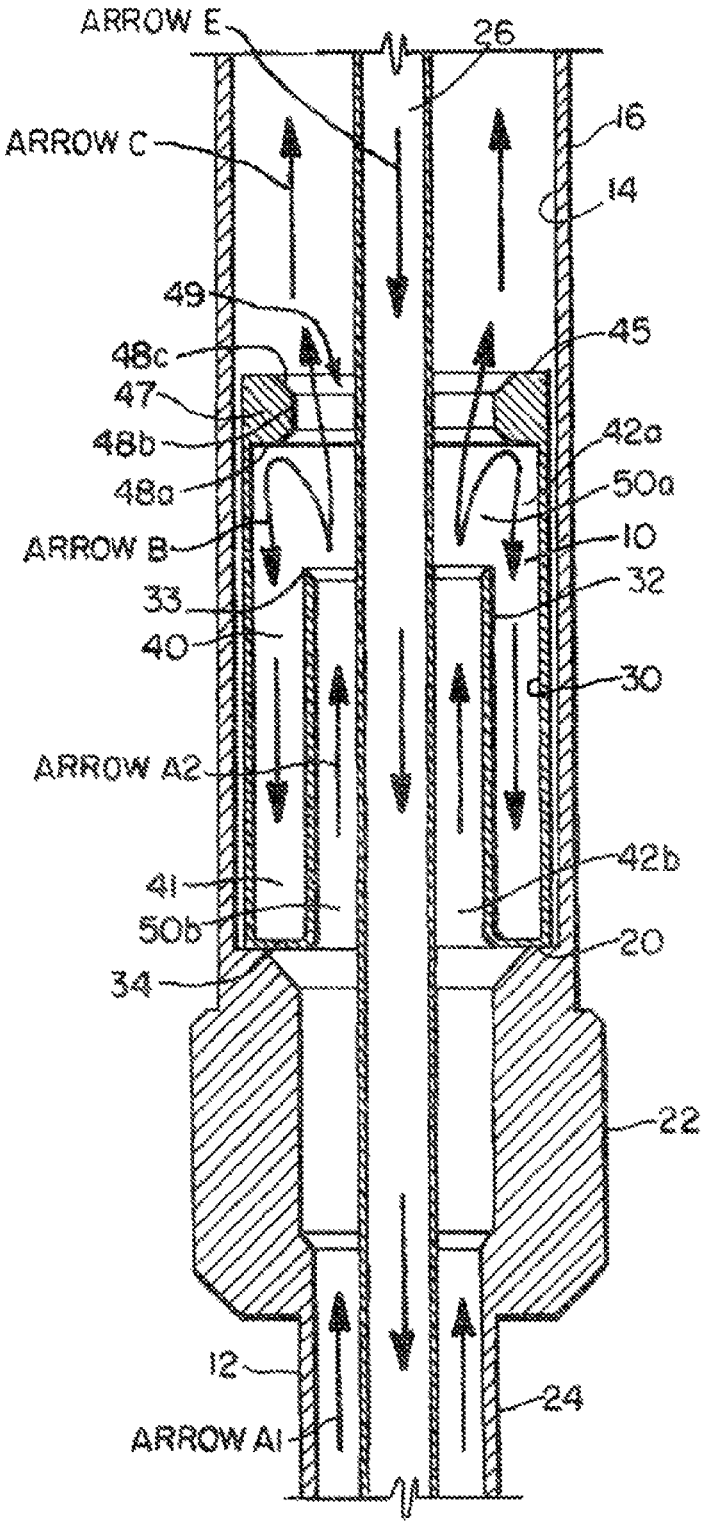
FIG. 3 illustrates a cross-sectional view of the autonomous junk collecting sleeve installed in a riser above a subsea tree section in accordance with the present invention.

Referring now to the drawings and particularly FIGS. 2-3, an autonomous junk collecting sleeve is designated by the reference numeral 10. The autonomous junk collecting sleeve 10 is operable to be positioned in a riser 16, such as defined by the interior surface 14 of the riser 16, to collect debris from a wellbore 12 such as during cleaning operations. The riser 16 is followed by a subsea tree section 22. The subsea tree section 22 is followed by the casing wall 24 of the wellbore 12.

Wellbores are cleaned after a hole is drilled and the casing wall 24 is set in place. In order to save time and money, operators generally prefer to run the cleaning work string into the wellbore just once if possible. It usually takes one to four days to clean a wellbore 12 of leftover drilling fluids, cement bits, iron debris and caked deposits on the casing wall 24. For wells having risers (generally a temporary tube connecting the surface drilling operation to the sea floor which is typically a few hundred feet to several thousand feet long) are usually cleaned in two operations. In a first cleaning operation, a short string is used to clean from upper surface to the subsea tree section 22. In a second cleaning operation, a long string is generally used to clean from the subsea tree section 22 to the wellbore depth. Very high fluid flow rates can be used to clean the riser 16 during the first cleaning operation. In one aspect, the autonomous junk collecting sleeve 10 may be used after the riser 16 is cleaned because it may be most efficient in trapping debris coming up from the wellbore 12. Furthermore, the autonomous junk collecting sleeve 10 may remain in the riser 16 until the clean up operations are complete.

During cleaning operations, a work string 26 is lowered downhole in the wellbore 12 for cleaning operations. The interior surface of the casing wall 24 may be in fluid communication with a hydrocarbon formation. As best seen in FIG. 3, the riser 16 has an inner diameter ID which is larger than the ID of the subsea tree section 22 and/or the casing wall 24. The transition between a larger riser ID to a smaller subsea tree ID creates a riser seat 20. The subsea tree section 22 may have one or more sub-sections with varying IDs one of which may be dimensioned to coincide with the ID of the casing wall 24 immediately below the subsea tree section 22.

In general, the autonomous junk collecting sleeve 10 is constructed and arranged to be independently lowered and seated above the subsea tree section 22 on the riser seat 20 and, subsequently, raised and removed independently of the work string 26. For example, the junk collecting sleeve 10 may be fished from the riser 16. Alternately, the junk collecting sleeve 10 may be raised with the work string 26. The autonomous junk collecting sleeve 10 may be comprised of tough steel that may be easily welded, such as 4130.

FIG. 2 illustrates a perspective view of an autonomous junk collecting sleeve 10 with a portion removed. FIG. 3 illustrates a cross-sectional view of the autonomous junk collecting sleeve 10 installed in the riser 16 above a subsea tree section 22. The autonomous junk collecting sleeve 10 comprises in general a first cylindrical structure 30, a second cylindrical structure 32 concentric to the first cylindrical structure 30 and a bottom basket floor 34. The second cylindrical structure 32 is shorter in length then the first cylindrical structure 30. The bottom basket floor 34 joins the first and second cylindrical structures 30 and 32 together at a lower end thereof in spatial relation to form an interior J-channel basket 40. The space relationship between the first and second cylindrical structures 30 and 32 creates a collecting space 41 to collect debris therein.

The larger diameter of the riser 16 enables the area of the collecting space 41 to be increased over other junk collecting spaces of other junk baskets dimensioned for use in the casing wall 24 below the subsea tree 22. Thus, the junk collecting sleeve 10 allows the larger size and/or heavier debris to be collected near the bottom of the riser 16. Furthermore, the outer diameter OD of the first cylindrical structure 30 is slightly smaller than the ID of the riser 16 to provide sufficient clearance between the first cylindrical structure 30 and the interior surface 14 of the riser 16 so that the sleeve 10 may be installed and removed without hindrance.

The longitudinal centers of the first and second cylindrical structures 30 and 32 are hollow. Thus, the upper portion of the first cylindrical structure 30 creates a first central hollow throughbore section 42*a* above the top edge 33 of the second cylindrical structure 32. The second cylindrical structure 32 creates a second central hollow throughbore section 42*b* having an inner diameter ID which is smaller than the ID of the first central hollow throughbore section 42*a*.

The first cylindrical structure 30 further includes a top side or edge 45 having brim 47. The brim 47 narrows the opening 49 at the top side or edge 45 of the first cylindrical structure 30. The opening 49 has an ID which is larger than the OD of a work string 26. The brim 47 is also constructed and arranged to allow the autonomous junk collecting sleeve 10 to be lowered to and fished out from the riser independently of the work string 26. The brim 47 may serve as a fish neck for attachment of a tool to lower, set and retrieve the sleeve 10.

In one configuration, the brim 47 is a solid structure contoured with a lower edge 48*a* extending a small distance from the inner surface of the first cylindrical structure 30. The distal end of the lower edge 48*a* away from the first cylindrical structure 30 curves or transitions upward and becomes essentially vertical to form a vertical surface 48*b* (curving in the direction toward the upper distal end of the first cylindrical structure 32). An upper portion 48*c* of the vertical surface 48*b* tapers, slopes or flares slightly back toward the first cylindrical structure 30 such that the ID of the opening 49 is slightly flared or increased.

The brim 47 may protrude a distance toward the second cylindrical structure 32 such that the distance approximates the distance between the first and second cylindrical structures 30 and 32. The brim 47 may be used as a guide.

The bottom end (coinciding with the plane of the bottom basket floor 34) of the central hollow throughbore section 42*b* of the second cylindrical structure 32 serves both as an inlet and outlet. Likewise, the opening 49 of the first cylindrical structure 30 provide both an inlet and an outlet. For example, as the work string 26 is lowered downhole, the work string 26 passes through and into opening 49 and, subsequently, out of the bottom end of the central hollow throughbore section 42*b*. Also, reverse fluid traveling upward to the top of the riser 16 in the direction of ARROWS A1 and A2, travels up through the bottom end of the central hollow throughbore section 42*b*.

The second central hollow throughbore section 42*b* has an inner diameter ID which is intended to be larger than the OD of the work string 26. Thus, an annulus 50*b* is defined between work string 26 and the interior circumferential surface of the second cylindrical structure 32. Likewise, an annulus 50*a* is defined between work string 26 and the interior circumferential surface of the first cylindrical structure 30. Annulus 50*b* is smaller than the annulus 50*a*. The enlarged annulus 50*a* followed by a narrowing about opening 49 promotes deflection of a portion of the reverse drilling fluid in the direction of ARROW B, the narrowing being generated by the protrusion of the brim 47. The placement of brim 47 allows fluid to slow and swirl thereunder. Thus, any debris or other heavy debris collecting in the interior annulus 50*a* promotes deposit of the debris within the interior J-channel basket 40. The upper portion 48*c* is sloped in a direction to promote feeding the reverse fluid out of opening 49 in the direction of ARROW C.

In one mode of operation, to install the autonomous junk collecting sleeve 10, the sleeve 10 is lowered to the bottom of riser 16 to rest on riser seat 20. A work string 26 may be installed downhole in the wellbore 12. Fluid flows downward in the direction of ARROWS E in the throughbore of the work string 26. During, cleaning operations, the fluid flowing in the direction of ARROWS E are emitted into the wellbore 12. The fluid carries debris in a reverse flow up to the top of the wellbore 12 and into the riser 16. This fluid passes into the annulus 50*b* and up to the enlarged annulus 50*a* to create eddy currents to deposit debris in the interior J-channel basket 40. After a predetermined period or at the end of a cleaning cycle, the autonomous junk collecting sleeve 10 is fished from the bottom of the riser 16 so that the interior J-channel basket 40 can be cleaned.

In one aspect, the autonomous junk collecting sleeve 10 remains in the riser 16 until cleaning operations are complete. In another aspect, the autonomous junk collecting sleeve 10 may be deployed, raised and re-deployed with or without the work string 26 downhole.

The wellbore cleaning operation preferably entails additional cleaning tools for liberating debris within the wellbore 12 such as may be accumulated along the interior surface of the casing wall 24. For example, a brush or scraper type tool may be positioned along the upper string, and/or a hydraulically powered jetting or circulating tool positioned below the junk basket.

During the wellbore cleaning operation, the cleaning tools may be used to liberate debris prior to and/or concurrently with passing fluid through the work string 26, then upward through the casing wall past the subsea tree section 22 and into the riser 16. Fluid is thus passed from the work string 26, downward through its center into the wellbore 12. Fluid passing into the wellbore 12 may gather and carry formation debris present within the wellbore 12. The fluid passes from the wellbore 12 upward to the riser 16 and through the annulus 50*b* or 50*a*, possibly carrying with it debris from the wellbore 12. Debris may be liberated using brushes, scrapers or a combination of brushes and scrapers. Furthermore, high velocity jets directed toward the casing wall may be used in combination with the brushes and/or scrapers.

Upon completion of the wellbore cleaning operation or drilling operations, the work string 26 may be moved upward from the wellbore 12. The autonomous junk collecting sleeve 10 may then be emptied into an appropriate waste receptacle and used again in subsequent wellbore cleaning operations.

Figure 4:
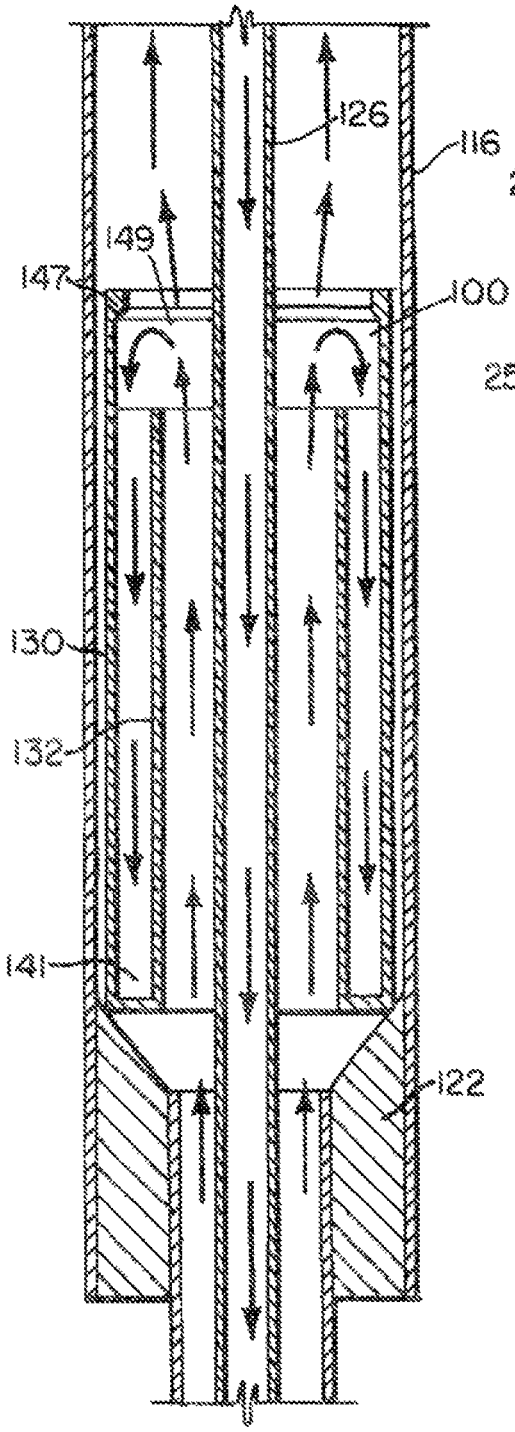
FIG. 4 illustrates a cross-sectional view of an alternate configuration of the autonomous junk collecting sleeve installed in a riser above a subsea tree section in accordance with the present invention.

FIG. 4 illustrates a cross-sectional view of an alternate configuration of the autonomous junk collecting sleeve 100 installed in a riser 116 above a subsea tree section 122 in accordance with the present invention. The autonomous junk collecting sleeve 100 has a longer length then the autonomous junk collecting sleeve 10. The longer length increases the length of the first and second cylindrical structures 130 and 132 to create a larger collecting space 141 to collect debris therein. Since, the autonomous junk collecting sleeve 100 is independent of the work string 126, the sleeve 100 may take advantage of the depth of the riser 116 to maximize the collecting space 141. The configuration of autonomous junk collecting sleeve 100 provides a smaller brim 147 which creates a smaller protrusion into the reverse fluid flow. Thus, any heavy debris carried away and out of opening 149 at the top of autonomous junk collecting sleeve 100, may float back down into the opening 149. The brim 147 may still be sufficient to attach a tool for lowering, setting and retrieving the autonomous junk collecting sleeve 100.

Figure 5:
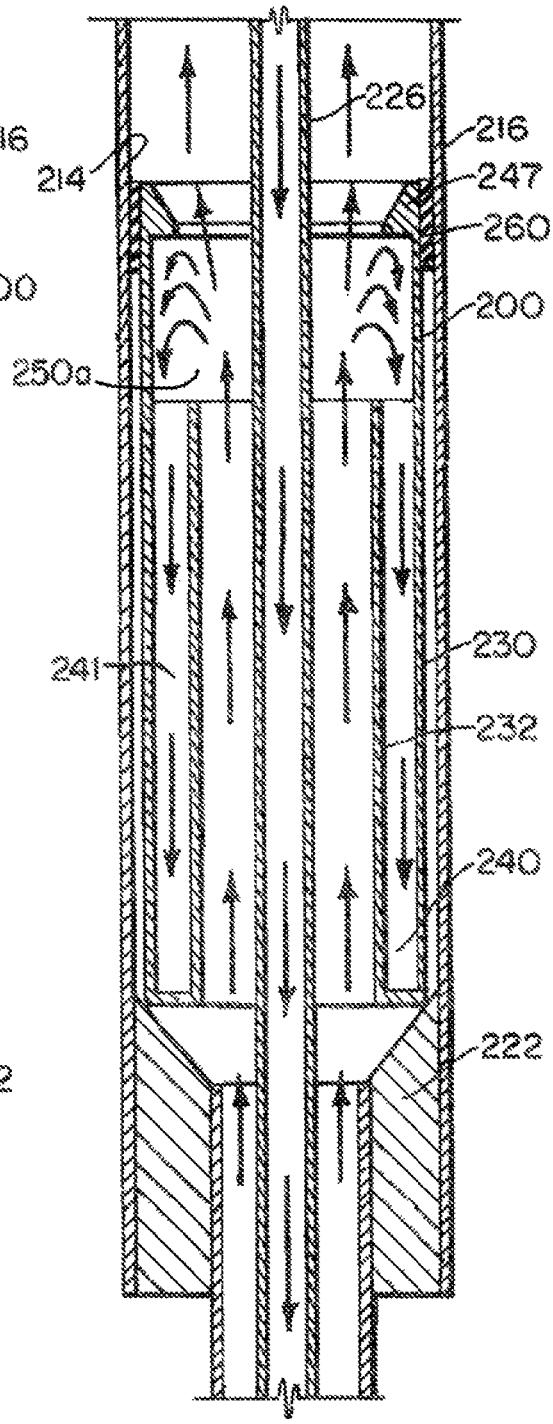
FIG. 5 illustrates a cross-sectional view of a still further alternate configuration of the autonomous junk collecting sleeve installed in a riser above a subsea tree section in accordance with the present invention.

FIG. 5 illustrates a cross-sectional view of a still further alternate configuration of the autonomous junk collecting sleeve 200 installed in a riser 216 above a subsea tree section 222 in accordance with the present invention. The autonomous junk collecting sleeve 200 has a longer length then both the autonomous junk collecting sleeves 10 and 100. The longer length increases the length of the first and second cylindrical structures 230 and 232 to create a larger collecting space 241 to collect debris therein. Since the autonomous junk collecting sleeve 200 is independent of the work string 226, the sleeve 200 may take advantage of the depth of the riser 216 to maximize collecting space 241. The configuration of autonomous junk collecting sleeve 200 provides a triangularly shaped brim 247. The brim 247 may protrude a distance toward the second cylindrical structure 232 such that the distance approximates the distance between the first and second cylindrical structures 230 and 232. The brim 247 may be used to attach a tool for lowering, setting and retrieving the autonomous junk collecting sleeve 200.

In this configuration, the increase in length of the first cylindrical structure 230 increases the length of the annulus 250*a* above the second cylindrical structure 232 to the brim 247. This added length may promote deposit of debris into the interior J-channel basket 240.

The autonomous junk collecting sleeve 200 further comprises a soft seal 260 around the outer perimeter of the first cylindrical structure 230 to buffer or protect the interior surface 214 of the riser 216 and the first cylindrical structure 230 during deployment and retrieval of the autonomous junk collecting sleeve 200. The soft seal 260 may comprise Neoprene Shore A 70.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

What is claimed is:

1. An autonomous junk collecting sleeve for a riser comprising:

a first outer cylindrical structure, a second inner cylindrical structure concentric to and shorter than the first outer cylindrical structure and which are joined together in spatial relation at a bottom end to form an interior J-channel basket, the J-channel basket being operable to collect debris traveling up through the bottom end and over a top edge of the second inner cylindrical structure for deposit therein, wherein the first outer cylindrical structure comprises, at a top end, a brim operable to attach a tool thereto to lower and retrieve the sleeve.

2. An autonomous junk collecting sleeve for a riser comprising:

a first outer cylindrical structure, a second inner cylindrical structure concentric to and shorter than the first outer cylindrical structure and which are joined together in spatial relation at a bottom end to form an interior J-channel basket, the J-channel basket being operable to collect debris traveling up through the bottom end and over a top edge of the second inner cylindrical structure for deposit therein, wherein the first outer cylindrical structure comprises a brim which protrudes from the first outer cylindrical structure toward a longitudinal axis of the first outer cylindrical structure a distance that approximates said spatial relation at said bottom end between the first outer cylindrical structure and the second inner cylindrical structure.

3. The sleeve according to claim 2, wherein the first outer cylindrical structure is longer in length than the second inner cylindrical structure and forms a hollow interior cavity above the top edge of the second inner cylindrical structure and below the brim.

4. An autonomous junk collecting sleeve for a riser comprising:

a first outer cylindrical structure, a second inner cylindrical structure concentric to and shorter than the first outer cylindrical structure and which are joined together in spatial relation at a bottom end to form an interior J-channel basket, the J-channel basket being operable to collect debris traveling up through the bottom end and over a top edge of the second inner cylindrical structure for deposit therein, wherein an outer diameter of the first outer cylindrical structure is slightly smaller than an inner diameter of the riser.

5. The sleeve according to claim 4, wherein the inner diameter of the second inner cylindrical structure is the same as or larger than an inner diameter of a subsea tree section.

6. An autonomous junk collecting sleeve for a riser comprising:

a first outer cylindrical structure, a second inner cylindrical structure concentric to and shorter than the first outer cylindrical structure and which are joined together in spatial relation at a bottom end to form an interior J-channel basket, the J-channel basket being operable to collect debris traveling up through the bottom end and over a top edge of the second inner cylindrical structure for deposit therein, wherein the sleeve is operable to be seated at a bottom of the riser and supported at a riser seat above a subsea tree section.

7. An autonomous junk collecting sleeve for a riser comprising:

a first outer cylindrical structure, a second inner cylindrical structure concentric to and shorter than the first outer cylindrical structure and which are joined together in spatial relation at a bottom end to form an interior J-channel basket, the J-channel basket being operable to collect debris traveling up through the bottom end and over a top edge of the second inner cylindrical structure for deposit therein, wherein the first outer cylindrical structure comprises, at a top end, a brim operable to allow autonomous retrieval of the sleeve from a bottom of the riser.

8. An autonomous junk collecting sleeve for a riser comprising:

a cylindrically-shaped, J-channel basket having a junk collecting space and a hollow throughbore center with access directly into the junk collecting space, the J-channel basket being operable to collect debris traveling up through the bottom end of the hollow throughbore center and over the access for deposit of said debris in the junk collecting space, further comprising a brim coupled to a top end of the J-channel basket, the brim being operable to attach a tool thereto to lower and retrieve the J-channel basket.

9. An autonomous junk collecting sleeve for a riser comprising:

a cylindrically-shaped, J-channel basket having a junk collecting space and a hollow throughbore center with access directly into the junk collecting space, the J-channel basket being operable to collect debris traveling up through the bottom end of the hollow throughbore center and over the access for deposit of said debris in the junk collecting space, wherein the J-channel basket comprises a first outer cylindrical structure, a second inner cylindrical structure concentric to and shorter than the first outer cylindrical structure and which are joined together in spatial relation at a bottom end.

10. The sleeve according to claim 9, wherein the first outer cylindrical structure comprises a brim which protrudes from the first outer cylindrical structure toward a longitudinal axis of the first outer cylindrical structure a distance that approximates said spatial relation at said bottom end between the first outer cylindrical structure and the second inner cylindrical structure.

11. The sleeve according to claim 10, wherein the first outer cylindrical structure is longer in length than the second inner cylindrical structure and forms an upper hollow throughbore center above a top edge of the second inner cylindrical structure and below the brim.

12. The sleeve according to claim 9, wherein an outer diameter of the first outer cylindrical structure is slightly smaller than an inner diameter of the riser.

13. The sleeve according to claim 12, wherein the inner diameter of the second inner cylindrical structure is the same as or larger than an inner diameter of a subsea tree section.

14. The sleeve according to claim 9, wherein the sleeve is operable to be seated at a bottom of the riser and supported at a riser seat above a subsea tree section.

15. The sleeve according to claim 9, wherein the first outer cylindrical structure comprises, at a top end, a brim operable to have attached thereto a fishing tool to autonomously retrieve the sleeve from a bottom of the riser.

16. A method of cleaning a wellbore comprising:

cleaning a riser from an upper surface to a subsea tree section;

lowering an autonomous junk collecting sleeve at a seat of the riser;

installing a work string through the riser and the autonomous junk collecting sleeve to a depth of the wellbore, the work string being independent of the sleeve;

cleaning a wellbore with the work string;

collecting debris from the wellbore in the autonomous junk collecting sleeve, simultaneously with the cleaning of the wellbore; and, during the cleaning of the wellbore, performing at least one of brushing and scraping of some of the debris from a casing wall of the wellbore.

17. The method according to claim 16, further including, during cleaning of the riser, employing very high fluid flow rates in the riser.

18. The method according to claim 16, further including, during the cleaning of the wellbore, moving the work string; and further including maintaining the autonomous junk collecting sleeve stationary at the seat of the riser during said moving of the work string.

19. The method according to claim 16, wherein the collecting of the debris includes collecting from the wellbore one or more of leftover drilling fluids, cement bits, iron debris and caked deposits from a casing wall in the autonomous junk collecting sleeve.

20. The method according to claim 19, further including, during the collecting of the debris, the following:

channeling drilling fluid through an annulus between the work string and a hollow throughbore center of the autonomous junk collecting sleeve; and accessing a junk collecting space of the autonomous junk collecting sleeve directly from the annulus to deposit the debris.

21. The method according to claim 16, further including:

fishing the autonomous junk collecting sleeve from the riser.

22. The method according to claim 21, wherein the fishing further includes:

fishing the autonomous junk collecting sleeve from the riser after the cleaning of the wellbore is complete.

23. The method according to claim 16, further including, during the cleaning of the wellbore, performing high velocity fluid jetting in the wellbore toward the casing wall.

* * * * *